United States Patent [19]

Kulik et al.

[11] 4,405,437

[45] Sep. 20, 1983

[54] PROCESS FOR COAL LIQUEFACTION EMPLOYING A SUPERIOR COAL LIQUEFACTION PROCESS SOLVENT

[75] Inventors: Conrad J. Kulik, Newark; Linda Atherton, Los Altos, both of Calif.

[73] Assignee: Electric Power Research Institute, Palo Alto, Calif.

[21] Appl. No.: 338,259

[22] Filed: Jan. 11, 1982

[51] Int. Cl.[3] ..... C10G 1/06; C10G 1/00

[52] U.S. Cl. ..... 208/10; 208/8 LE

[58] Field of Search ..... 208/10, 8 LE

[56] References Cited

U.S. PATENT DOCUMENTS

| | | | |
|---|---|---|---|
| 2,029,895 | 2/1936 | Rittmeister | 208/10 |
| 3,700,583 | 10/1972 | Solamony et al. | 208/8 LE |
| 4,049,536 | 9/1977 | Plumlee et al. | 208/8 LE X |
| 4,049,537 | 9/1977 | Plumlee et al. | 208/10 |
| 4,051,012 | 9/1977 | Plumlee et al. | 208/8 LE |
| 4,085,032 | 4/1978 | Aczel et al. | 208/10 |
| 4,090,958 | 5/1978 | Leonard | 208/8 LE |
| 4,119,524 | 10/1978 | Leonard et al. | 208/8 LE |
| 4,180,456 | 12/1979 | Moll et al. | 208/10 X |
| 4,300,994 | 11/1981 | Liotta | 208/8 LE |

FOREIGN PATENT DOCUMENTS

| | | | |
|---|---|---|---|
| 1287570 | 8/1972 | United Kingdom | 208/8 LE |

*Primary Examiner*—Delbert E. Gantz
*Assistant Examiner*—William G. Wright
*Attorney, Agent, or Firm*—William G. Addison

[57] ABSTRACT

A process for liquefying coal utilizing an indigenously derived solvent enriched in basic nitrogen heterocyclic compounds. Particulate coal is slurried with an aromatic hydrocarbon distillate start-up solvent. The slurry is reacted under predetermined conditions in a liquefaction reactor to form distillable and substantially nondistillable coal products. The distillables are removed and the nondistillable coal products are fractionated to produce a fraction enriched in basic nitrogen heterocyclic compounds. A portion of this fraction is recycled together with the distillable solvent to the coal liquefaction reactor. The blended solvent is slurried with coal and upon treatment in the liquefaction reactor converts the coal to distillate and soluble coal products in a higher yield than possible in a process not employing a solvent enriched in basic nitrogen heterocyclic compounds.

16 Claims, 2 Drawing Figures

FIGURE I

PROCESS FOR COAL LIQUEFACTION EMPLOYING A SUPERIOR COAL LIQUEFACTION PROCESS SOLVENT

BACKGROUND OF THE INVENTION

1. Field of the Invention

The present invention provides a coal liquefaction process by which to generate and employ a superior process derived solvent to liquefy coal.

2. Brief Description of the Prior Art

In conventional coal liquefaction processes, particulate coal is treated at an elevated temperature and pressure with a solvent and either with or without hydrogen gas and either with or without a catalyst to convert the coal into liquid and low melting temperature solid products. These products also can be further up-graded through catalytic hydrogenation to produce higher quality liquids and solids.

Presently, little is known of the exact mechanisms by which the coal is transformed into soluble form or of the detailed molecular structure of coal and the soluble coal products. It is known that many coals are easily solubilized and for others solublization is more difficult. It is believed that coal may be comprised of a loose structure of molecules bonded together by hydrogen bonds and numerous weak chemical bonds. If the coal is not properly treated during the early stages of the solubilization, the coal can thermally regress to a highly refractory polynuclear structure which results in production of little of the desired distillate range products or lighter liquids. Some correlations have been made between the rank of the coal and ease of the solublization and product yield. Little is known as to how to optimize these yields and improve the product quality.

The initial products produced by a coal liquefaction process such as solvent refined coal (SRC) may have utility as a substitute clean fuel or boiler fuel. However, for substitute fuels of higher quality, particularly distillate fuels, specifications on viscosity, melting point, ash, nitrogen and sulfur contents are much more stringent. Attempts to meet these specifications by operating the coal liquefaction process under more severe operating conditions have met with many difficulties. For example, the processes have experienced low liquid and high gas yields, high hydrogen consumption, difficulty of separating residue and ash and excessive retrogressive product formation which often completely plugs process transfer lines and reactors.

Alternative methods of improving product specifications through catalytic hydrogenation also are difficult. The problems which arise include: (i) a susceptibility of the liquefaction products to retrogress and deposit on the catalyst used for their conversion; (ii) diffusion limitations of the catalyst as the molecular size of the coal liquefaction products approach the pore size of conventional catalysts; and (iii) catalyst poisoning by metal contaminants and other contaminants, such as, nitrogenous compounds, contained in the coal liquefaction products.

It is known that the composition of the products produced during a coal liquefaction process depend not only upon the nominal process operating conditions such as temperature, pressure and residence time, but also upon the solvent employed. It is known that a "good" solvent reduces the production of gases and lower quality products, such as preasphaltenes, and increases the production of higher quality distillate products. It would be desirable to provide a means by which a solvent can be produced which will upon liquefaction of the coal permit production of the desired coal liquefaction products with minimum consumption of hydrogen.

SUMMARY OF THE INVENTION

The present invention provides a process for liquefying coal utilizing a superior indigenously derived recycle solvent containing an enriched content of basic nitrogen heterocyclic compounds, such as, quinoline, tetrahydroquinoline, indoline, quinolinediol, and the like which when employed as a coal liquefaction solvent improves distillate and soluble coal yields from coal.

A particulate coal is slurried with an aromatic hydrocarbon distillate start-up liquefaction solvent. The slurry is preheated and further reacted in a liquefaction reactor under predetermined conditions wherein the coal is converted to distillable and substantially nondistillable products. Those products, intermingled with the coal liquefaction solvent, then are subjected to distillation. The distillation products are utilized later in the process as described hereinafter.

The remaining substantially nondistillable coal products are deashed and fractionated utilizing a deashing solvent near or at its critical temperature and pressure. This produces a fraction comprising a substantially nondistillable coal product fraction that is enriched in basic nitrogen heterocyclic compounds. This fraction is admixed with the distillation products produced as described above. The distillation products comprise distillable coal liquefaction solvent and distillable coal products boiling in the same range as the coal liquefaction solvent.

The resulting blended solvent then is slurried with a particulate coal. The slurry is preheated and further reacted in a liquefaction reactor to effect the conversion of the coal and of the substantially nondistillable basic nitrogen heterocyclic compounds to distillable and soluble coal products. The conversion of the substantially non-distillable basic nitrogen heterocyclic compounds to the distillable range effectively increases the concentration of distillable basic nitrogen heterocyclic compounds in the distillable boiling range designated for the coal liquefaction solvent. The coal liquefaction solvent enriched in distillable basic nitrogen heterocyclic compounds then is recycled in the process.

Sufficient nondistillable basic nitrogen compounds are recycled such that the distillable coal liquefaction solvent contains from about 5 to near 100 percent by weight basic nitrogen heterocyclic compounds. Thereafter, the level is maintained by continued recycle of the substantially nondistillable basic nitrogen heterocyclic compounds. This enriched coal liquefaction solvent produces substantially higher distillate and soluble coal yields from coal during treatment under the described liquefaction conditions in comparison to a coal liquefaction process not employing a coal liquefaction solvent enriched in basic nitrogen heterocyclic compounds.

DESCRIPTION OF THE PREFERRED EMBODIMENT

Figure 1:
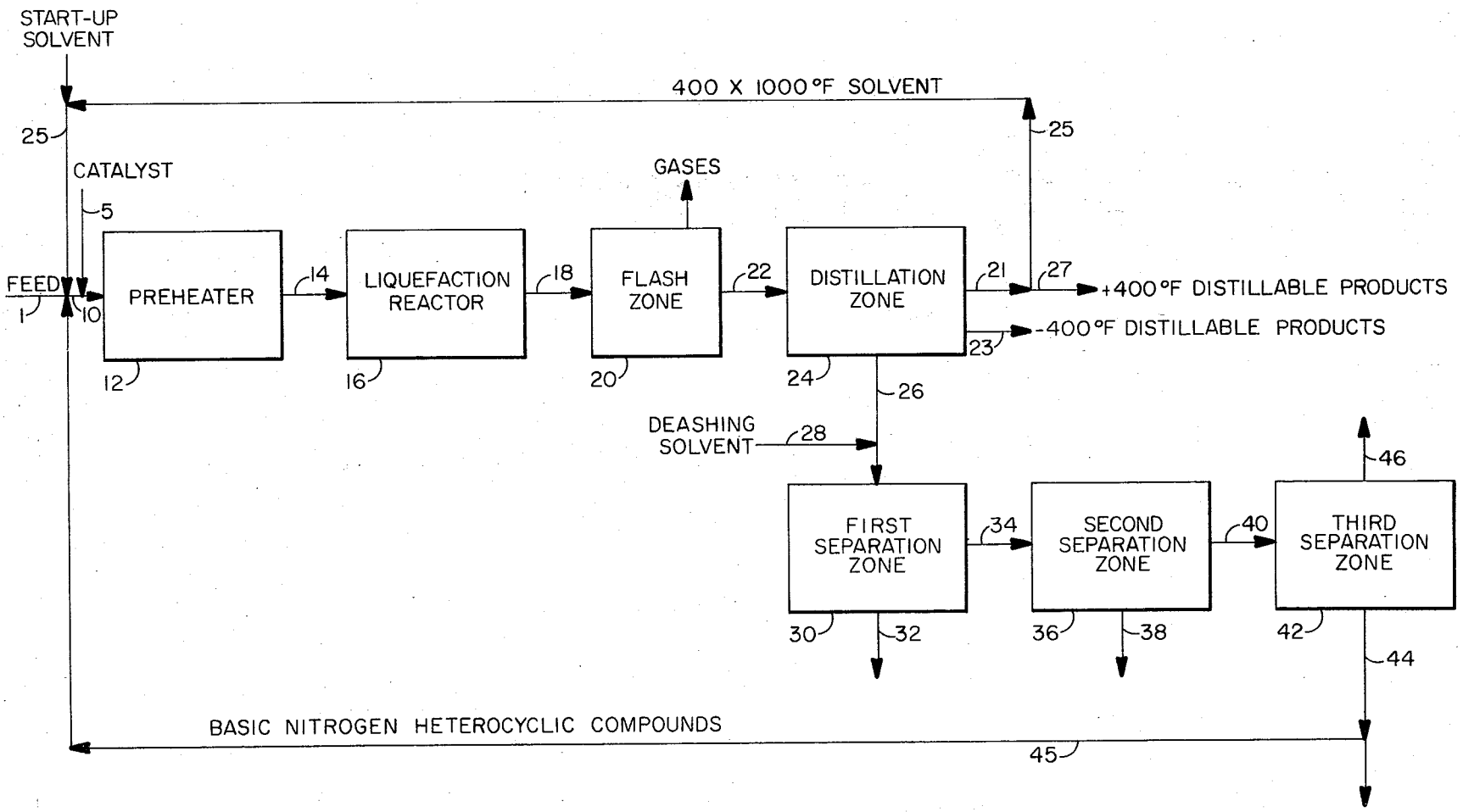
FIG. 1 is a diagrammatic, schematic illustration of the coal liquefaction process of the present invention.

Turning now to FIG. 1, a coal feed comprising bituminous coal, subbituminous coal or the like in dried or undried condition is based through a conduit 1 either with or without the addition of a catalyst, such as, $Fe_2SO_4.8H_2O$ or $(NH_4)_2MoO_4$ or the like introduced through a conduit 5, and is admixed with a distillate solvent flowing through a conduit 25 to form a slurry. The distillate solvent can comprise mixtures of aromatics, hydroaromatics, naphthenics, phenolics, quinolines, tetrohydroquinoline, indolines, and similar compounds but preferably is a solvent containing a high concentration of basic nitrogen heterocyclic compounds, such as for example, 1,2,3,4-tetrahydroquinoline, indoline and the like having a boiling point temperature in the range of from about 400° F. to about 1000° F. A suitable distillate solvent for starting the process is the commercial product of coal pyrolysis generally known as creosote oil or anthracene oil or a petroleum derived distillate concentrated in basic nitrogen heterocyclics. Sufficient solvent is admixed with the coal to provide a ratio, by weight, of coal to solvent in the range of from about 1:1.2 to about 1:3.

On start-up, a recycleable heavy phase enriched in substantially nondistillable basic nitrogen heterocyclics will not be available. Once available, however, such recycled heavy phase will be used as a component to provide a blended liquefaction solvent. The blended liquefaction solvent can contain from about 5 to about 100 percent by weight basic nitrogen heterocyclic compounds. It is preferred that the ratio of distillate to recycled heavy phase be about a 70/30 weight ratio. It is preferred that the recycled heavy phase contain at least 15 to 25 percent by weight substantially nondistillable basic nitrogen heterocyclic compounds.

The slurry then is pressurized and introduced through a conduit 10 into a preheater 12 wherein the slurry is subjected to elevated temperatures and pressures. Preferably, gaseous hydrogen is present during the preheating. The preheated slurry then is passed through a conduit 14 and introduced into a liquefaction reactor 16 maintained at an elevated temperature and pressure. In reactor 16, the coal and recycled heavy phase undergo conversion to form coal liquefaction products and distillable basic nitrogen heterocyclics in admixture with the solvent. Reactor residence times can be from about 5 minutes to 3 hours. With the preferred residence time being less than 1 hour. Hydrogen gas, synthesis gas or the like can be introduced into the slurry prior to entry into the reactor or while within the reactor. The presence of this additional hydrogen aids in the conversion of the coal feed. The temperature level normally is maintained in the range of from about 700° F. to about 1000° F. and preferably is maintained at about 700° F. to about 850° F. The reactor exit hydrogen partial pressure level normally is maintained in a range of from about 1000 psig. to about 5000 psig. and preferably from about 1000 psig. to about 2500 psig. The liquefaction conditions are selected to provide those which optimally convert the coal to distillable products and convert the recycled heavy phase to a distillate range solvent enriched in basic nitrogen heterocyclics.

Preferably, at least a portion of the converted recycled heavy phase comprises tetrahydroquinolines, such as, 1,2,3,4-tetrahydroquinoline. It may be convenient but not necessary to perform this operation in two reactors with the conversion to distillates being effected in the first reactor and the partial hydrogenation of basic nitrogen heterocyclics such as quinoline to hydrogenated compounds such as tetrahydroquinolines being effected in the second reactor.

The coal liquefaction products together with the distillable basic nitrogen heterocyclics and solvent are withdrawn from reactor 16 through a conduit 18 and introduced into a flash zone 20. The coal liquefaction products, distillable basic nitrogen heterocyclics and solvent are flashed to separate gases and light organic liquids. Because of the solubility of basic nitrogen heterocyclics in water and their relatively high volatility, care must be taken not to lose the basic nitrogen heterocyclics in extraneous process streams. The flashed coal liquefaction products, distillable basic nitrogen heterocyclics and solvent then are introduced into a distillation zone 24 through a conduit 22 and subjected to vacuum or atmospheric distillation to separate the intermingled distillable solvent and distillable soluble coal products incrementally enriched in basic nitrogen heterocyclics from the nondistillables. It is preferred that the recovered coal liquefaction recycle solvent boil between 400° F. to 1000° F. The 400°×1000° F. distillate fraction is withdrawn from distillation zone 24 through a conduit 21. Excess 400°×1000° F. distillate above that which is required for recycle solvent can be removed as product through conduit 27. The −400° F. distillate fraction is withdrawn from distillation zone 24 through a conduit 23. The residue comprises substantially nondistillable soluble coal products and insoluble coal products.

In the process of converting the coal and recycled heavy phase to such distillable and nondistillable soluble coal products, a portion of the solvent is consumed or otherwise lost in the apparatus in the process. To permit continuous operation of the liquefaction process, a portion of the intermingled distillable soluble coal products produced in the process normally are recycled to supplant the lost solvent through conduit 25. Continued process operation eventually will result in the complete replacement of the original solvent with a process-derived solvent. The quality and chemical nature of this process-derived solvent is of critical importance in establishing the manner in which coal is liquefied and plays a predominate role in controlling product selectivity. In particular, it has been found that the quantity of basic nitrogen heterocyclic compounds present in the solvent particularly tetrahydroquinolines and indoline and the like have a significant effect upon the yield of distillable coal products and light liquids.

It has been found that continuous operation of the coal liquefaction process in a traditional manner with a distillable process-derived solvent results in a gradual reduction in conversion efficiency because of a decrease in the quality of the solvent separated from the coal liquefaction products. It has been found that the basic nitrogen heterocyclic compounds are cracked and ultimately lost as ammonia or recombined through regressive or other reactions with other molecules to become substantially insoluble. The absence of these compounds decreases the efficiency of the recycled solvent and results in the production of an increased quantity of preasphaltenes and a reduction in production of the more desirable products.

It has been found that the basic nitrogen heterocyclic compounds in the distillable solvent can be replaced and increased in concentration with basic nitrogen compounds recovered from the substantially nondistillable soluble coal products. The presence of these basic nitrogen compounds particularly partially saturated compounds, such as 1,2,3,4-tetrahydroquinoline and indoline have been found to improve the quality of the solvent and significantly improve the yield of distillates and oils produced by the liquefaction process.

The residue, comprising substantially nondistillable soluble coal products and insoluble coal products, is withdrawn through a conduit 26 and admixed with a deashing solvent introduced through a conduit 28 to form a prepared mixture which is introduced into a first separation zone 30. Sufficient deashing solvent is admixed with the residue to provide a ratio by weight of coal liquefaction products to deashing solvent in the prepared mixture in the range of from about 1:1 to about 1:10. It is to be understood that larger quantities of the deashing solvent may be employed, however, such larger quantities generally are unnecessary.

The term "deashing solvent" as used herein refers to those solvents consisting essentially of at least one substance having a critical temperature below 800° F. selected from the group consisting of: aromatic hydrocarbons having a single benzene nucleus and normal boiling points below about 310° F., such as benzene, toluene, o-, m- and p-xylene, ethyl benzene, isopropyl benzene and monocyclic aromatic hydrocarbons in general having normal boiling points below about 310° F.; cycloparaffin hydrocarbons having normal boiling points below about 310° F., such as cyclobutane, cyclopentane, cyclohexane, cycloheptane, and nonaromatic monocyclic hydrocarbons in general having normal boiling points below about 310° F.; open chain monoolefin hydrocarbons having normal boiling points below about 310° F., such as butene, pentene, hexene and heptene; open chain saturated hydrocarbons having normal boiling points below about 310° F., such as pentane, hexane and heptane; mono-, di, and tri-open chain amines containing from about 2–8 carbon atoms, such as ethyl, propyl, butyl, pentyl, hexyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs.

The first separation zone 30 is maintained at a temperature level in the range of from about 400° F. to about 700° F. and a pressure level in the range of from about 600 psig. to about 1500 psig. to effect a separation of the prepared mixture. The prepared mixture is caused to separate into a first light phase comprising deashing solvent and the substantially nondistillable soluble coal products and a first heavy phase comprising insoluble coal products and some deashing solvent.

The first heavy phase is withdrawn from first separation zone 30 through a conduit 32 and can be treated by flashing or the like to separate the deashing solvent from the insoluble coal products. The separated deashing solvent then can be recycled in the process.

The first light phase is withdrawn from first separation zone 30 through a conduit 34 and is introduced into a second separation zone 36. An additional quantity of deashing solvent can be admixed with the first light phase, if desired, to facilitate the subsequent fractionation of the soluble coal products that are present. The additional deashing solvent can comprise the same deashing solvent as is present or any other member of the group. The initial deashing solvent also can be separated from the first light phase prior to addition of the additional quantity of deashing solvent as hereinafter described in an alternate embodiment of the invention in the event a different member of the group is employed.

The second separation zone 36 is maintained at a temperature level in the range of from about 425° F. to about 750° F. and a pressure level in the range of from about 400 psig. to about 1500 psig. The heating of the first light phase to the temperature of second separation zone 36 can be achieved, for example, by passage through a heater (not shown).

The particular temperature and pressure conditions in second separation zone 36 are selected to provide a differential in the deashing solvent density existing within first separation zone 30 and second separation zone 36 sufficiently large to cause the first light phase to separate into a second light phase and a second heavy phase. The second light phase comprises deashing solvent and light soluble coal products. The second heavy phase comprises heavy soluble coal products and some deashing solvent.

The second heavy phase is withdrawn from second separation zone 36 through a conduit 38 and treated to recover the deashing solvent, for example, by flashing to produce one stream comprising deashing solvent and another stream comprising the remainder of the second heavy phase now referred to as a heavy solvent refined coal fraction. This heavy solvent refined coal fraction, upon cooling to about ambient temperature, will form a low melting temperature solid suitable for use as fuel, for example, for a boiler.

In one embodiment, the second light phase is withdrawn from second separation zone 36 through a conduit 40 and introduced into a third separation zone 42. Third separation zone 42 is maintained at a temperature level in excess of the temperature level in second separation zone 36. Generally, the temperature level will be in the range of from about 450° F. to about 800° F. The pressure level with separation zone 42 is maintained in the range of from about 400 psig. to about 1500 psig. and preferably is maintained at about the same pressure level as second separation zone 36, allowing for normal pressure drop that occurs through connecting conduit 40. The heating of the second light phase to the temperature of third separation zone 42 can be achieved, for example, by passage through a heater (not shown).

The particular temperature and pressure conditions in third separation zone 42 are selected to provide a differential in the deashing solvent density existing within second separation zone 36 sufficiently large to cause the second light phase to separate into a third light phase and a third heavy phase. The third heavy phase comprises deashing solvent and a portion of the light soluble coal products, more specifically, a fraction rich in basic nitrogen heterocyclic compounds. The third light phase comprises the remainder of the deashing solvent and light soluble coal products. The third heavy fraction is withdrawn from third separation zone 42 through a conduit 44. The third heavy phase can be treated, if desired, to separate the deashing solvent, for example, by flashing to produce at least one stream comprising deashing solvent and one other stream comprising at least a portion of the substantially nondistillable basic nitrogen heterocyclic compounds. A portion of the substantially nondistillable basic nitrogen compounds withdrawn from conduit 44 through a conduit 45 then are admixed with the distillable solvent in conduit 25 separated from the coal liquefaction products in distillation zone 24 to provide a blended solvent stream for recycle in the coal liquefaction process. The quantity of third heavy phase admixed is sufficient to provide a basic nitrogen compound content from the heavy third phase of at least about 5 percent by weight of the total blended solvent.

In addition, a portion of this substantially nondistillable soluble coal products stream third heavy phase can be utilized to replenish those portions of the distillable solvent that have been consumed or lost in the process, including that which was allowed to remain in the distillation residue fed to the deashing and fractionation step.

Figure 2:
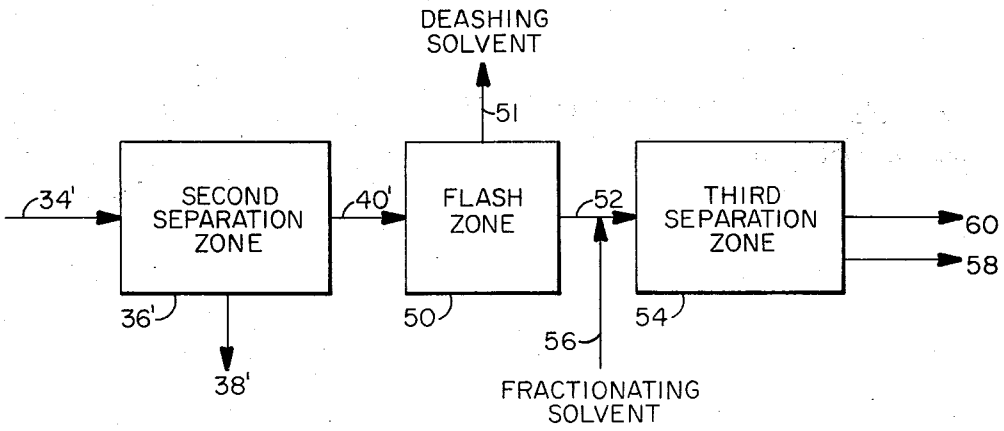
FIG. 2 is a diagrammatic, schematic illustration of an alternate embodiment of the process of the present invention.

Turning now to FIG. 2, an alternate embodiment of the present invention is illustrated. In this embodiment, the second light phase is withdrawn from second separation zone 36' and treated to separate the deashing solvent, for example, by flashing in a flash zone 50 to produce one stream comprising deashing solvent and one other stream comprising soluble coal products. The separated deashing solvent is withdrawn from flash zone 50 through a conduit 51 and recycled in the process. The soluble coal products from flash zone 50 are introduced into a third separation zone 54 through a conduit 52. It is to be understood that the deashing solvent also can be separated from the soluble coal products by any other suitable method, such as for example, by increasing the temperature while maintaining or reducing the pressure level to cause the solvent to separate as a separate phase from the soluble coal products. A fractionating solvent is introduced into conduit 52 through a conduit 56 to admix with the soluble coal products. The fractionating solvent comprises a substance which can specifically separate basic nitrogen heterocyclic compounds from the remaining soluble coal product.

Suitable fractionating solvents can comprise polar solvents such as, for example, pyrrolidine, piperidine, methanol, aniline and the like or a member or combination of the members of the group comprising the deashing solvent. While the specific mechanism presently is unknown, it is believed that the fractionation occurring in this embodiment of the process of the invention is a manifestation of the Marangoni effect. When a hydrocarbon fluid containing a mixture of polar and nonpolar species is contacted with a polar solvent, interfacial tension forces tend to cause the polar species to concentrate at the fluids surface. These polar species are rapidly extracted by the polar solvents. A description of the effect and appropriate apparatus and operational information is set forth in U.S. Pat. No. 4,180,456 issued to N. G. Moll et al, the entire disclosure of which is incorporated herein by reference.

The third separation zone is maintained at a temperature level in the range of from about 400° F. to about 800° F. and a pressure level in the range of from about 400 psig. to about 1500 psig. The heating of the mixture can be effected by heating either the fractionating solvent or the soluble coal products prior to admixing by passage through a heater (not shown). Alternatively, the mixture can be heated within third separation zone 54 by steam tubes or the like (not shown).

The particular temperature and pressure conditions in third separation zone 54 are selected to provide a differential in the fractionating solvent density within zone 54 sufficient to cause the soluble coal products to separate into a third heavy phase and a third light phase. The extraction or separation can be effected at a temperature near to or above the critical temperature and pressure of the fractionating solvent. Depending upon the fractionation solvent selected and the operating conditions, the third heavy phase can comprise substantially nondistillable basic nitrogen heterocyclic compounds and some fractionating solvent and the third light phase would comprise the remaining soluble coal products and most of the fractionating solvent. If a polar solvent is employed, the third light phase would comprise substantially nondistillable basic nitrogen heterocyclics and a substantial portion of the fractionation solvent and the third heavy phase would comprise the remainder of the soluble coal products and some fractionating solvent.

The fraction containing the substantially nondistillable basic nitrogen heterocyclic compounds is withdrawn from third separation zone 54 through a conduit 58. This fraction can be treated to separate any fractionating solvent that is present, for example, by flashing to produce at least one stream comprising the fractionating solvent and one other stream comprising the substantially nondistillable basic nitrogen heterocyclic compounds. A portion of the basic nitrogen compounds are admixed with the distillable solvent containing the lower molecular weight basic nitrogen heterocyclic compounds separated from the liquefaction products as previously described.

The fraction comprising the remaining soluble coal products is withdrawn from third separation zone 54 through a conduit 60 and can be treated to separate the fractionating solvent, for example, flashing to produce at least one stream comprising fractionating solvent and one other stream comprising at least a portion of the substantially nondistillable soluble coal products. A portion of this soluble coal product stream also can be recycled to supplant distillable solvent loses as previously described. The remaining soluble coal products, if any, are recovered.

To further illustrate the process of this invention, and not by way of limitation, the following examples are provided.

Example I

A coal liquefaction is performed in which particulate Kentucky No. 9 coal is admixed with a hydrocarbon distillate coal-derived solvent having a boiling point temperature range of from about 400° F. to about 1000° F. and containing about 0.18 weight percent nitrogen in a coal to solvent ratio of about 1.6:1, by weight. The slurry thus formed is pressurized, preheated and introduced into a liquefaction reactor together with hydrogen gas. The temperature in the reactor is maintained at about 833° F. The hydrogen gas inlet pressure to the reactor is about 1722 psig. The feed rate of the slurry to the reactor is about 39 lbs. of coal/hu-ft$^3$. The reactor effluent is flashed and vacuum distilled to separate the distillates and recover the solvent for recycle. The yield of ash free vacuum residuum was 51.5 weight percent of the moisture and ash free coal feed of which 81.2 weight percent was recovered in subsequent deashing steps.

Example II

In accordance with the process of the present invention, particulate Kentucky No. 9 coal is admixed with a coal-derived solvent similar to that of Example I having a boiling point temperature range of from about 400° F. to about 1000° F. containing about 0.18 weight percent nitrogen to which is added a recycled heavy phase enriched in basic nitrogen heterocyclic compounds in a 70/30 weight ratio of solvent to recycled heavy phase to form a blended solvent to coal weight ratio of 1.6:1. The slurry thus formed is pressurized, preheated and introduced into a liquefaction reactor together with hydrogen gas. The temperature in the reactor is maintained at about 784° F. The hydrogen gas inlet pressure to the reactor is about 1840 psig. The feed rate of the slurry to the reactor is about 33 lbs. of coal/hr-ft$^3$. The reactor effluent, comprising coal liquefaction products, is flashed and vacuum distilled to separate the distillates and recover the solvent for recycle.

The liquefaction product residue remaining after distillation of the distillable soluble coal products is admixed with a deashing solvent comprising an aromatic hydrocarbon fraction having a boiling temperature in the range of from about 175° F. to about 300° F. The liquefaction product to deashing solvent ratio is about 1:2, by weight. The admixture is introduced into a first separation zone maintained at a temperature level in the range of about 550° F. to about 580° F. and a pressure of about 900 psig. The admixture separates into a first light phase and a first heavy phase comprising insoluble coal products and some deashing solvent. The first light phase is introduced into a second separation zone. The second separation zone is maintained at a temperature level in the range of from about 600° F. to about 750° F. and a pressure of about 865 psig. The first light phase separates into a second light phase comprising light soluble coal products and deashing solvent and a second heavy phase. The second light phase is withdrawn from the second separation zone and introduced into a third separation zone. The third separation zone is maintained at a temperature level in the range of from about 600° F. to about 700° F. and a pressure of about 585 psig. The second light phase separates into a third light phase and a third heavy phase. The third heavy phase comprising a fraction rich in basic nitrogen heterocyclic compounds and some deashing solvent is withdrawn from the third separation zone and flashed to separate the deashing solvent. A portion of the fraction of basic nitrogen heterocyclic compounds is recycled to coal liquefaction and is admixed with the distillable solvent to form the blended solvent. This recycle is continued until the nitrogen content of the distillate solvent is increased from about 0.18 weight percent to a level of about 0.58 weight percent. The distillate solvent with the enriched nitrogen content then was used to make another coal liquefaction run at the same liquefaction conditions as Example I. This enriched solvent is admixed with particulate Kentucky No. 9 coal in a ratio of coal to solvent of 1:1.6 to form a slurry. The slurry is pressurized, preheated and introduced into a reactor together with hydrogen gas as in Example I. The temperature in the reactor is maintained at about 840° F. The hydrogen gas exit pressure from the reactor is about 1722 psig. The feed rate of the slurry to the reactor is about 39 lbs of coal/hr-ft$^3$. The reactor effluent is flashed and vacuum distilled to separate the distillable coal liquefaction products and solvent. The distillables are fractionated to separate the solvent fraction having a boiling temperature in the range of from about 400° F. to about 1000° F. from the remaining distillables. The substantially nondistillable residue is admixed with a deashing solvent comprising an aromatic hydrocarbon fraction having a boiling temperature in the range of from about 175° F. to about 300° F. in a ratio of coal liquefaction products to deashing solvent of about 1:2.6, by weight. The admixture is introduced into a first separation zone maintained at a temperature level in the range of from about 500° F. to about 600° F. and a pressure of about 9000 psig. The admixture separates into a first light phase and a first heavy phase. The first light phase is introduced into a second separation zone maintained at a temperature level in the range of from about 600° F. to about 700° F. and a pressure of about 850 psig. The first light phase separates into a second light phase and a second heavy. The second light phase is introduced into a third separation zone maintained at a temperature level in the range of from about 600° F. to about 700° F. and a pressure of about 585 psig. The second light phase separates into a third light phase and a third heavy phase. The yield of ash free vacuum residuum products is about 58.5 weight percent of the moisture and ash free coal feed. Thereafter, about 90.1 weight percent of the ash free products are recovered in the deashing step.

The benefits that derive from practice of the process of the present invention clearly are illustrated by the improvement in the soluble coal yield of the coal liquefaction process when operated in accordance with the process of the present invention.

The term "insoluble coal product" as used herein refers to the undissolved coal, mineral matter, other solid inorganic particulate matter and other such matter which is insoluble in the process solvent and deashing solvent under the conditions of the process of this invention.

The term "soluble coal product" as used herein refers to the constituent fractions in the coal which are soluble in the liquefaction process solvent and deashing solvent.

The term "distillable soluble coal product" as used herein refers to the constituent fractions of the soluble coal product having a boiling point temperature below about 850° F.

The term "substantially nondistillable soluble coal product" as used herein refers to the constituent fractions of the soluble coal product having an initial boiling point temperature above about 850° F.

The term "light soluble coal product" as used herein refers to those fractions of the soluble coal product having a density less than the average density of the soluble coal product introduced as feed into a designated separation zone.

The terms "heavy soluble coal product" and "heavy solvent refined coal" as used herein refer to those fractions of the soluble coal product having a density greater than the average density of the soluble coal product introduced as feed into a designated separation zone.

While the subject invention has been described with regard to what is considered to be the preferred embodiment thereof, it is to be understood that changes or modifications can be made in the process disclosed without departing from the spirit or scope of the invention as defined by the following claims.

What is claimed is:

1. A process for coal liquefaction employing a superior coal liquefaction solvent comprising:

admixing a particulate coal with a distillable aromatic hydrocarbon solvent having a boiling temperature in the range of from about 400° F. to about 950° F. to form a slurry;

heating the slurry to a temperature level in the range of from about 700° F. to about 1000° F. in the presence of an hydrogen gas while maintaining the slurry at a pressure in the range of from about 1000 psig. to about 5000 psig. to effect a conversion of the coal in the slurry to coal liquefaction products comprising distillable and substantially nondistillable soluble coal products and insoluble coal products in admixture with the distillable aromatic hydrocarbon solvent;

distilling said coal liquefaction products to separate said intermingled distillable aromatic hydrocarbon solvent and distillable soluble coal products from the remainder;

admixing said remainder with a deashing solvent to form a prepared mixture;

separating said prepared mixture into a first light phase and a first heavy phase comprising insoluble coal products and some deashing solvent by maintaining the prepared mixture at a first temperature level in the range of from about 400° F. to about 700° F. and a pressure in the range of from about 600 psig. to about 1500 psig;

heating said first light phase to a second temperature level higher than the first temperature level while maintaining the pressure in the range of from about 600 psig. to about 1500 psig. to effect a separation of said first light phase into a second light phase comprising light soluble coal products and deashing solvent and a second heavy phase comprising heavy soluble coal products and some deashing solvent;

heating said second light phase to a third temperature level higher than the second temperature level while maintaining the pressure in the range of from about 600 psig. to about 1500 psig. to effect a separation of said second light phase into a third light phase and a third heavy phase comprising a fraction rich in basic nitrogen heterocyclic compounds;

admixing a portion of said fraction rich in basic nitrogen heterocyclic compounds with the intermingled distillable aromatic hydrocarbon solvent and distillable soluble coal products recovered from admixture with the coal liquefaction products to form a coal liquefaction solvent having a substantially nondistillable and distillable basic nitrogen heterocyclic compounds content of at least about 5 percent by weight of said coal liquefaction solvent;

contacting said coal liquefaction solvent with a particulate coal at a temperature in excess of about 700° F. in the presence of an hydrogen gas while maintaining a pressure in excess of about 1000 psig. for from about 10 minutes to 3 hours to effect a conversion of said particulate coal and said substantially nondistillable basic nitrogen heterocyclic compounds to coal liquefaction products and distillable basic nitrogen heterocyclic compounds having a boiling point of from about 400° to 1000° F.;

recovering said distillables boiling from 400° to 1000° F. that have been enriched in distillable basic nitrogen heterocyclic compounds; and recycling said distillables as a coal liquefaction solvent.

2. The process of claim 1 wherein said deashing solvent consists essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

3. The process of claim 1 wherein said substantially nondistillable basic nitrogen heterocyclic compounds are recycled in sufficient quantity to comprise from about 1 to 70 percent by weight of said coal liquefaction solvent.

4. The process of claim 1 wherein a catalyst is added to effect the conversion of said coal and substantially nondistillable basic nitrogen heterocyclic compounds to distillable coal products and distillable basic nitrogen heterocyclic compounds.

5. The process of claim 1 wherein said particulate coal contacted with said coal liquefaction solvent is undried moisture-containing coal.

6. The process of claim 1 wherein said contacting of said coal liquefaction solvent with said particulate coal is effected in two reactors, said coal being converted to an admixture of distillable and nondistillable coal products in said first reactor, the entire effluent of which then is treated in the second reactor to convert at least a portion of said substantially nondistillable basic nitrogen heterocyclic compounds in said admixture to distillables boiling in the range of from about 400° F. to 1000° F.

7. The process of claim 6 wherein a catalyst is utilized to catalyze the partial saturation of the distillable basic nitrogen heterocyclic compounds in the second reactor.

8. The process of claim 6 wherein said particulate coal contacted with said coal liquefaction solvent is undried moisture-containing coal.

9. A process for coal liquefaction employing a superior coal liquefaction solvent comprising:

admixing a particulate coal with a distillable aromatic hydrocarbon solvent having a boiling temperature in the range of from about 400° F. to about 950° F. to form a slurry;

heating the slurry to a temperature level in the range of from about 700° F. to about 1000° F. in the presence of an hydrogen gas while maintaining the slurry at a pressure in the range of from about 1000 psig. to about 5000 psig. to effect a conversion of the coal in the slurry to coal liquefaction products comprising distillable and substantially nondistillable soluble coal products and insoluble coal products in admixture with the distillable aromatic hydrocarbon solvent;

distilling said coal liquefaction products to separate said intermingled distillable aromatic hydrocarbon solvent and distillable soluble coal products from the remainder;

admixing said remainder with a deashing solvent to form a first mixture;

separating said first mixture into a first light phase and a first heavy phase comprising insoluble coal products and some deashing solvent by maintaining the prepared mixture at a first temperature level in the range of from about 400° F. to about 700° F. and a pressure in the range of from about 600 psig. to about 1500 psig.;

admixing at least a portion of said first light phase with a fractionating solvent to form a second mixture;

fractionating said second mixture to produce a fraction rich in substantially nondistillable basic nitrogen heterocyclic compounds;

admixing a portion of said fraction rich in basic nitrogen heterocyclic compounds with the intermingled distillable aromatic hydrocarbon solvent and distillable soluble coal products recovered from admixture with the coal liquefaction products to form a coal liquefaction solvent having a substantially nondistillable and distillable basic nitrogen heterocyclic compounds content of at least about 5 percent by weight of said coal liquefaction solvent;

contacting said coal liquefaction solvent with a particulate coal at a temperature in excess of about 700° F. in the presence of an hydrogen gas while maintaining a pressure in excess of about 1000 psig. for from about 10 minutes to 3 hours to effect a conversion of said particulate coal and said substantially nondistillable basic nitrogen heterocyclic compounds to coal liquefaction products and distillable basic nitrogen heterocyclic compounds having a boiling point of from about 400° to 1000° F.;

recovering said distillables boiling from 400° to 1000° F. that have been enriched in distillable basic nitrogen heterocyclic compounds; and recycling said distillables as a coal liquefaction solvent.

10. The process of claim 9 wherein said deashing solvent consists essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

11. The process of claim 9 wherein fractionating said second mixture is defined further as heating said second mixture to a temperature level near to or above the critical temperature of the fractionating solvent while maintaining the pressure level sufficient to maintain at least a portion of said second mixture in the liquid phase to cause said mixture to separate into a fraction rich in substantially nondistillable basic nitrogen heterocyclic compounds and another fraction comprising the remainder of said portion of said first light phase.

12. The process of claim 11 wherein the pressure level is maintained above the critical pressure of the fractionating solvent.

13. The process of claim 12 wherein the temperature level is maintained above the critical temperature of the fractionating solvent.

14. The process of claim 11 wherein the fraction rich in substantially nondistillable basic nitrogen heterocyclic compounds is separated together with a substantial portion of the fractionating solvent from the remainder.

15. The process of claim 11 wherein the fraction rich in substantially nondistillable basic nitrogen heterocyclic compounds is separated as a fractionating solvent-lean heavy phase from the fractionating solvent-rich remainder.

16. The process of claim 9 wherein said particulate coal contacted with said coal liquefaction solvent is undried moisture-containing coal.

* * * * *